US006234235B1

(12) United States Patent
Ming

(10) Patent No.: US 6,234,235 B1
(45) Date of Patent: May 22, 2001

(54) STRUCTURE OF A VENETIAN BLIND

(76) Inventor: Nien Ming, P.O. Box 82-144, Taipei (TW)

( * ) Notice: Subject to any disclaimer, the term of this patent is extended or adjusted under 35 U.S.C. 154(b) by 0 days.

(21) Appl. No.: 09/512,204

(22) Filed: Feb. 24, 2000

(30) Foreign Application Priority Data

Dec. 13, 1999 (TW) ..... 088221196

(51) Int. Cl.[7] ..... E06B 9/30

(52) U.S. Cl. ..... 160/168.1 R; 160/178.1 R; 160/902

(58) Field of Search ..... 160/168.1 R, 173 R, 160/178.1 R, 902, 903

(56) References Cited

U.S. PATENT DOCUMENTS 1,949,653 * 3/1934 Moore ..... 160/168.1 R X
4,177,853 * 12/1979 Anderson et al. ..... 160/168.1 R
5,348,068 * 9/1994 Eisenheimer et al. ..... 160/176.1
5,391,967 * 2/1995 Domel et al. ..... 160/168.1 R X
5,505,418 * 4/1996 Corcoran ..... 160/178.1 R X
5,816,308 * 10/1998 De Hoyos ..... 160/176.1 R
5,845,694 * 12/1998 Cohen ..... 160/168.1 R
5,975,184 * 11/1999 Nien et al. ..... 160/902 X
6,009,931 * 1/2000 Peterson ..... 160/902 X
6,056,035 * 5/2000 Laster-Bivens ..... 160/168.1 R X

* cited by examiner

*Primary Examiner*—Bruce A. Lev
(74) *Attorney, Agent, or Firm*—A & J

(57) ABSTRACT

A Venetian blind having a head rail with a plurality of ladder cords and vertical cords vertically mounted and spaced apart therebelow, a plurality of slats being positioned between the ladder cords and the vertical cords formed a shade, the bottom of the head rail being a lower rail, characterized in that the external edge of the head rail is mounted with an upper rail formed from plastic injection molding for enabling cutting the length thereof, the cross-section of the upper rail is substantially "U" shaped and the edges of the upper rail are individually provided with two hook-like edges, and a plurality of holes are provided on the upper rail for the insertion of the ladder cords, the vertical cords, and a lift cord, to thereby provide support for a venetian blind within various sized structural openings.

1 Claim, 4 Drawing Sheets

STRUCTURE OF A VENETIAN BLIND

BACKGROUND OF THE INVENTION a) Technical Field of the Invention

The present invention relates to an improved structure of a Venetian blind, and in particular, to a Venetian blind of simple structure such that the cost of manufacturing is low, and the blind has an aesthetic appearance.

b) Description of the Prior Art

FIG. 1 shows a conventional Venetian blind having a substantially U-shaped head rail 10 formed by bending an iron plate or by plastic molding. The bottom of the head rail 10 is provided with a plurality of ladder cords 11 spaced apart forming a support for a plurality of slats 12. The bottom of the ladder cord 11 is provided with a heavy rod 13, and the top of the ladder cord 11 is mounted to a control device 20 to control a control rod 21 of the control device 20 so as to elevate the slats 12 at the sides of the ladder cord 11. Thus, the tilting angle of the slats 12 is adjusted to allow the amount of sunlight to enter. In addition, a plurality of vertical cords 14, passing through individual slats 12, are connected to the heavy rod 13 and one end thereof surrounds the head rail 10. Due to the positioning device 30 at one side of the head rail 10 extended to the bottom of the blind forming into a lift cord 15, the heavy rod 13 can be lifted up and the slats 12 are thus stacked one by one. By lowering the heavy rod 13, the individual slats 12 return to their spaced apart position.

However, there are drawbacks found in this conventional Venetian blind as follows:

1) There are various specifications for the Venetian blind, which are not easily adapted to window of various sizes.
2) In order to comply with the size of the window, various types of head rails have to be made in order to insert the ladder cord 11, the vertical cord 14, the lift cord 15 and the control rod 20. Thus, the cost of manufacturing is increased.
3) The strength of the conventional Venetian blind is insufficient as the head rail 10 is normally made from an iron plate and is bent into a "U" shaped structure. As there are a plurality of holes on the head rail 10, it cannot withstand heavy weight.

SUMMARY OF THE INVENTION

The present invention relates to an improved structure of a Venetian blind, and in particular, to a Venetian blind of simple structure such that the cost of manufacturing is low, and the blind has an aesthetic appearance.

Accordingly, it is an object of the present invention to provide an improved structure of a Venetian blind having a head rail with a plurality of ladder cords and vertical cords vertically mounted and spaced apart therebelow, a plurality of slats being positioned between the ladder cords, and the vertical cord being formed into horizontal support, the bottom of the head rail being a lower rail, characterized in that the external edge of the head rail is mounted with an upper rail formed from plastic injection molding, and the cross-section of the upper rail is substantially a "U" shape and the edges of the upper rail are individually provided with two hook-like edges, and a plurality of holes are provided on the upper rail for the insertion of the ladder cords the vertical cords and a lift cord, thereby the upper rail of various sizes is adapted to the fixed size head rail.

DETAILED DESCRIPTION OF THE PREFERRED EMBODIMENT

Figure 1:
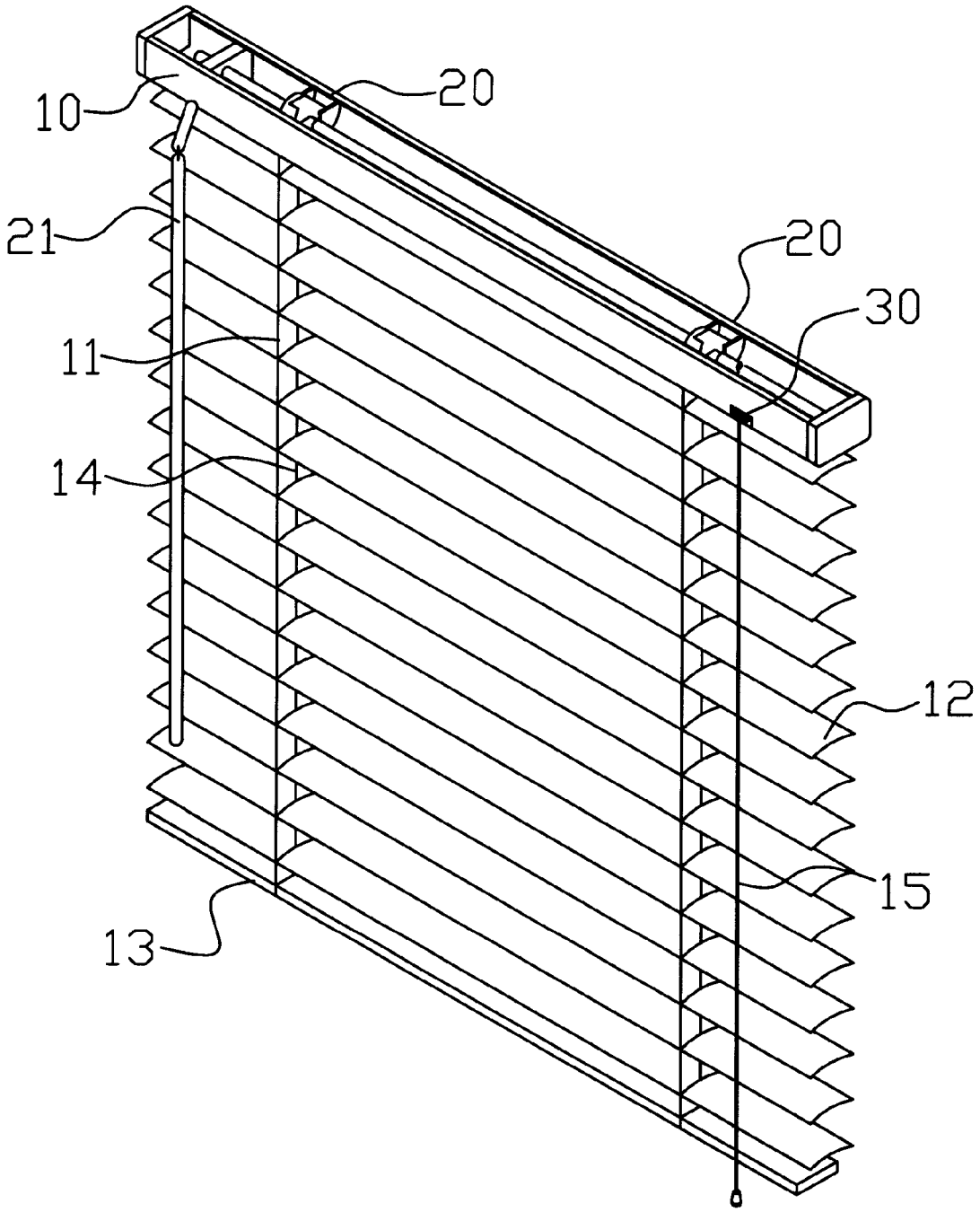
PRIOR ART FIG. 1
FIG. 1 is a perspective view of a conventional Venetian blind.
Figure 2:
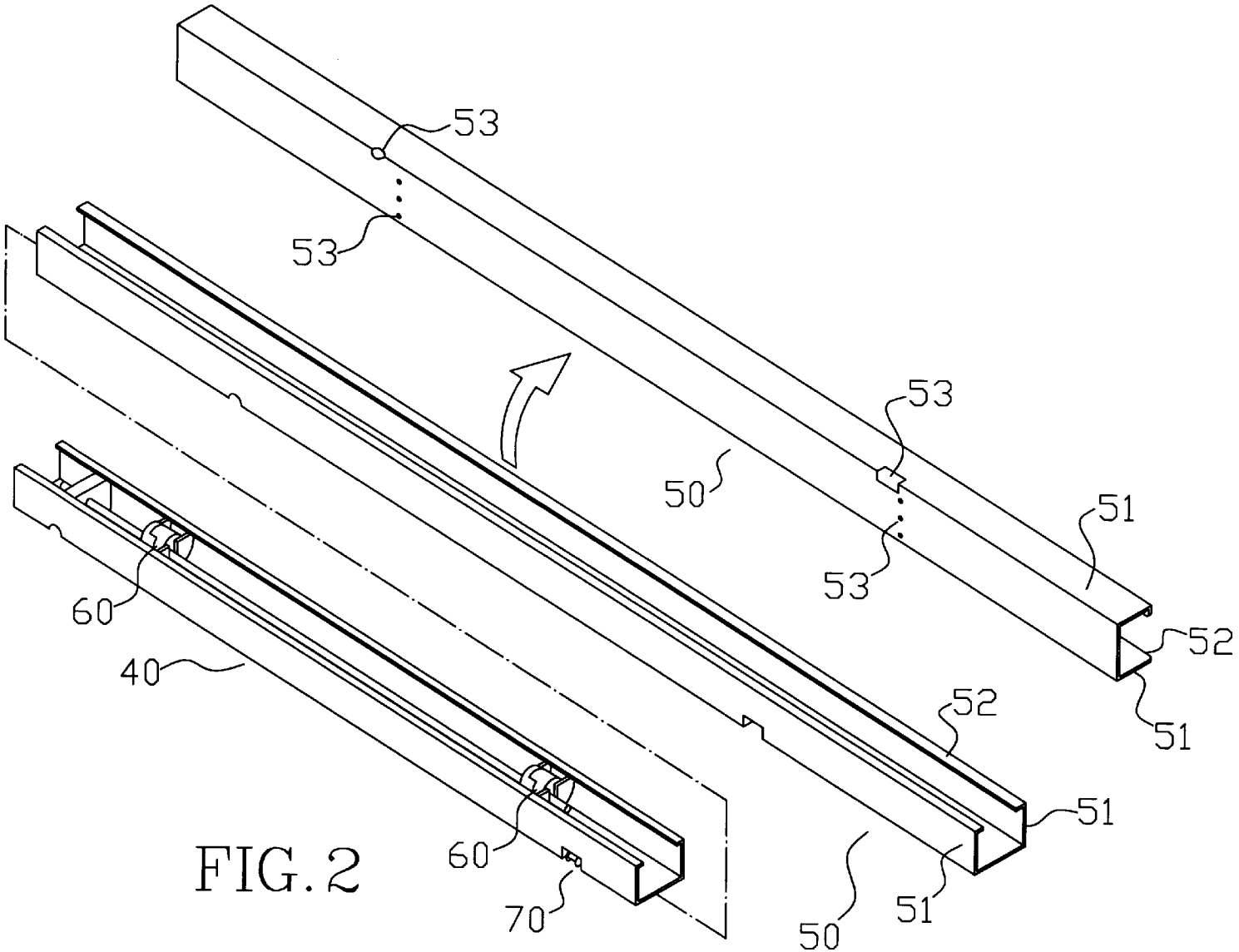
FIG. 2 is a perspective exploded view of the head rail and the upper rail of the blind of the present invention.
Figure 3:
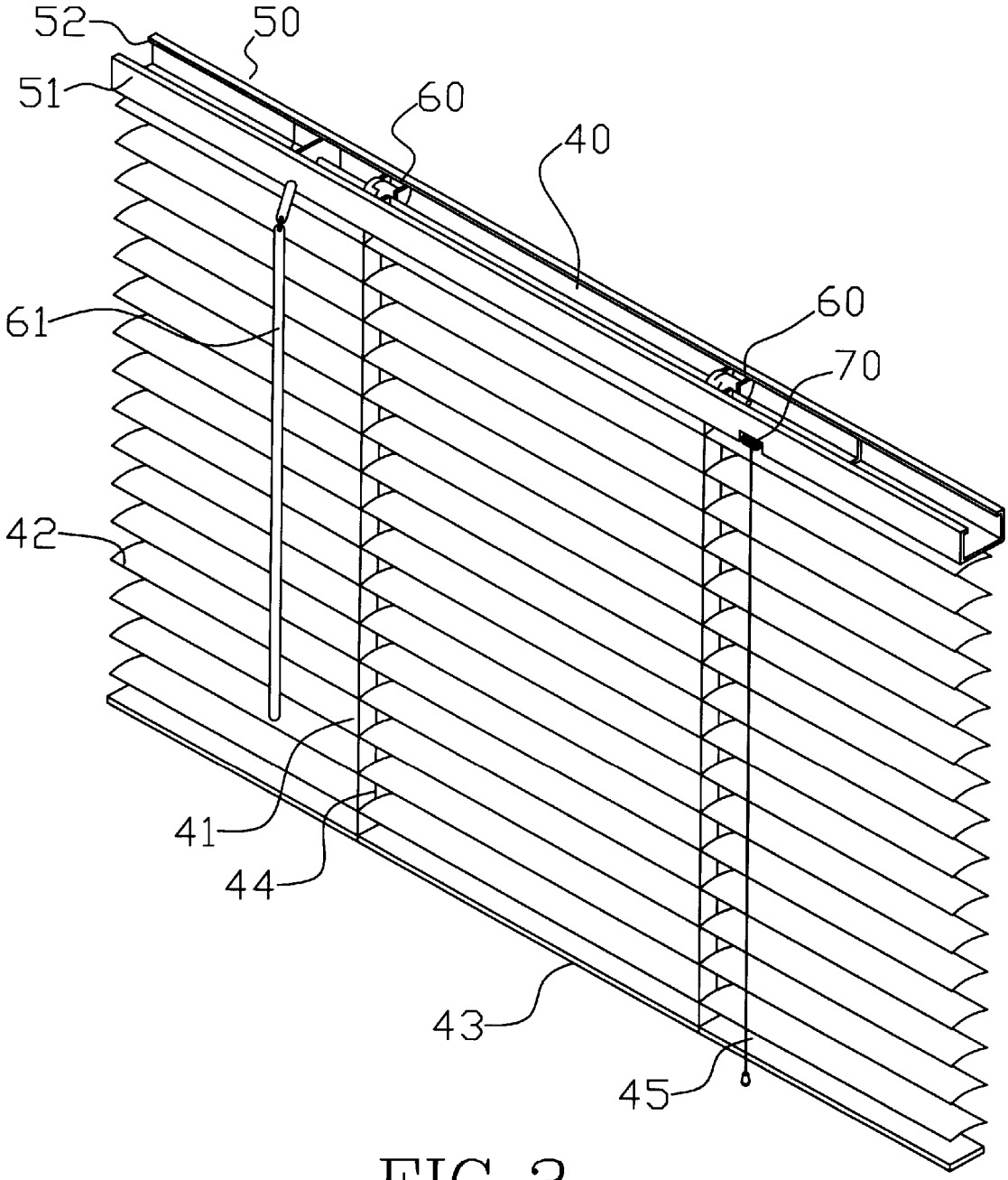
FIG. 3 is a perspective view of the blind of the present invention.
Figure 4:
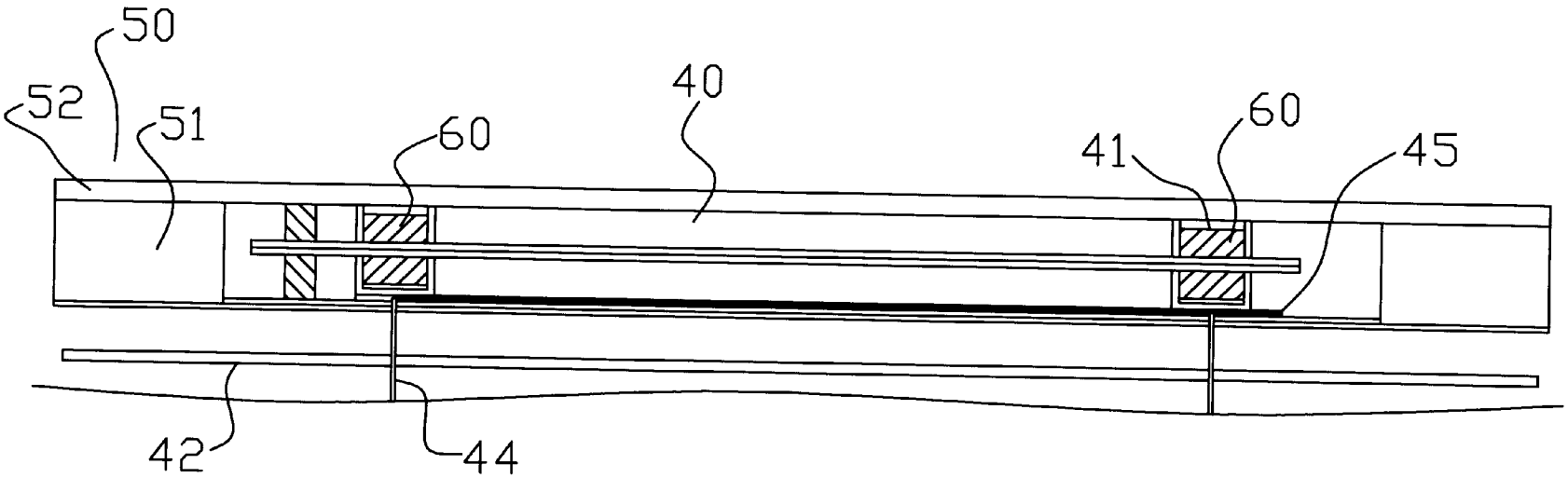
FIG. 4 is a sectional view of the blind of the present invention.

Referring to FIGS. 2 to 4, there is shown an improved structure of a Venetian blind of the present invention comprising a head rail 40 mounted externally with an upper rail 50, a plurality of ladder cords 41 and vertical cords 44 being mounted below the upper rail 50, and a plurality of slats 42 being provided horizontally on the ladder cords 41 and the bottom section of the blind being a lower rail 43, wherein the head rail 40 is made into a substantially rectangular box like structure, and the upper rail 50 is made by plastic injection molding. In accordance with the present invention, the shape of the cross-sectional of the upper rail 50 is a substantially U-shaped structure, and at the top edge of two lateral side 51 of the upper rail 50, an inverted hook-like edge 52 is provided for the mounting with the head rail 40. On the upper rail 50, a plurality of holes 53 are provided for the insertion of the ladder cords 41, the vertical cords 44, the lift cord 45 and a control rod 61. The top end of the ladder cord 41 is fixed with a control device 60 such that by rotating the control rod 61 of the control device 60, the ladder cord 41 at the side of the slats 42 is controlled to tilt so as to change the tilting angle of the slats 42 to allow the sunlight to enter. The vertical cords 44, passing through the slats 42, are located in between the head rail 40 and the lower rail 43, and the bottom ends of the vertical cords 44 are mounted onto the lower rail 43, and one end of the vertical cord 44 surrounds the head rail 40. A positioning device 70 mounted at one side of the head rail 40 and the lift cord 45 is mounted to the bottom section of the blind. Thus, the lower rail 43 can be lifted such that the slats 42 are stacked together, or when the lower rail 43 is released, the individual slats 42 are restored to space apart with an interval.

In accordance with the present invention, there are advantages as compared to the conventional Venetian blinds:

1) The size of the Venetian blinds is adaptable to all sizes of windows. The head rail 40 of the present invention is mounted externally with an upper rail 50, the head rail 40 is made into a fixed size and then is mounted with the upper rail 50 made of different sizes. As the upper rail 50 is made from plastic injection, the making of holes or cutting is simple and quick. Therefore, it suits window of all sizes.
2) The cost of production is low.

The head rail 40 can be mass produced and therefore the cost of material for manufacturing the head rail 40 is lowered.
3) The strength of the upper rail is strong and the rail possesses an aesthetic appearance.

As the upper rail 50 is made by plastic molding, various types of embossed designs can be made to the upper rail 50 so as to add an aesthetic appearance to the upper rail 50. In addition, the upper rail 50 is adapted by the head rail 40 which is made from a metallic material, therefore, the strength of the upper rail 50 is increased.

While the invention has been described with respect to a preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

What is claimed is:

1. A venetian blind comprising a head rail, a plurality of spaced apart ladder cords, vertical cords, and a lift cord; a plurality of slats positioned between and connected to said ladder cords, vertical cords, and lift cord forming a shade; said head rail having an elongated U-shaped top section and an elongated U-shaped bottom section; said bottom section having a fixed length along with lift and tilt controls mounted therein, wherein said bottom section is slidably received within the U-shape of said top section; said top section being formed from plastic injection molding to thereby provide means for cutting the length thereof to fit within various sized structural openings; said top and bottom sections each having inwardly extending edges that interengage when the bottom section is within the U-shape of the top section to thereby hold the sections together; said top section further comprising a plurality of holes in a bottom wall wherein said ladder cords, vertical cords, and a lift cord pass from the bottom section through the top section and extend downwardly therefrom, such that the top section supports the bottom section, the ladder cords, vertical cords, and a lift cord, and thereby the shade downwardly therefrom for providing support means for the blind within various sized structural openings.

* * * * *